US006279641B1

(12) United States Patent
Malott

(10) Patent No.: US 6,279,641 B1
(45) Date of Patent: Aug. 28, 2001

(54) COVER DESIGN FOR RETRACTABLE AWNINGS

(75) Inventor: Dale G. Malott, Middlebury, IN (US)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/265,458

(22) Filed: Mar. 10, 1999

(51) Int. Cl.[7] ..... E04F 10/06

(52) U.S. Cl. ..... 160/67; 160/229.1; 160/235; 160/236; 135/89

(58) Field of Search ..... 160/54, 61, 62, 160/63, 66, 67, 133, 228, 229–1, 233, 235, 236; 135/89

(56) References Cited

U.S. PATENT DOCUMENTS

| | | | | |
|---|---|---|---|---|
| 677,123 | * | 6/1901 | Ebner | 160/235 |
| 1,367,240 | * | 2/1921 | Cornell | 160/236 |
| 1,813,525 | | 7/1931 | Astrup . | |
| 2,189,525 | | 2/1940 | Treffeisen . | |
| 2,204,363 | * | 6/1940 | Jenkins et al. | 160/235 |
| 2,354,485 | * | 7/1944 | Slaughter | 160/235 |
| 2,641,018 | * | 6/1953 | Snyder | 160/235 |
| 2,787,321 | | 4/1957 | Dietz . | |
| 2,799,464 | | 7/1957 | D'Azzo . | |
| 2,890,853 | | 6/1959 | D'Azzo . | |
| 2,894,572 | * | 7/1959 | Nelson | 160/67 |
| 3,263,735 | | 8/1966 | Vecchiarilli et al. . | |
| 3,478,806 | | 11/1969 | Darula . | |
| 3,485,287 | * | 12/1969 | Milbourne, Sr. | 160/236 |
| 3,720,438 | | 3/1973 | Johnson et al. . | |
| 3,825,023 | | 7/1974 | Bergeron . | |
| 4,433,714 | * | 2/1984 | Barber | 160/235 |
| 4,576,192 | | 3/1986 | Duda . | |
| 4,634,172 | | 1/1987 | Duda . | |
| 4,726,153 | | 2/1988 | Adler et al. . | |
| 4,909,296 | | 3/1990 | Sellke et al. . | |
| 4,924,895 | | 5/1990 | Bailie . | |
| 4,941,524 | | 7/1990 | Greer . | |
| 5,433,259 | | 7/1995 | Faludy . | |
| 5,437,322 | | 8/1995 | Murray . | |
| 5,477,903 | * | 12/1995 | Figueiredo et al. | 160/233 X |
| 5,560,411 | | 10/1996 | Becker . | |
| 5,622,214 | | 4/1997 | Baka et al. . | |
| 5,957,186 | * | 9/1999 | Boswell | 160/236 X |

FOREIGN PATENT DOCUMENTS

| | | | | |
|---|---|---|---|---|
| 2224062 | * | 4/1990 | (GB) | 160/233 |

* cited by examiner

*Primary Examiner*—Bruce A. Lev
(74) *Attorney, Agent, or Firm*—Pearne & Gordon LLP

(57) ABSTRACT

A retractable awning assembly includes a roller, arm assemblies supporting ends of the roller, an awning rail securable to a support wall, a flexible canopy rollable on the roller and having an outer edge secured to the roller and an inner edge connected to the awning rail, and an articulated protective cover connecting the flexible canopy to the awning rail. The protective cover includes a plurality of slats hingedly connected one to another along adjacent edges such that the cover protects the canopy when in a retracted position and is an extension of the canopy when in an extended position. Each of the slats has an upper surface and a flat stop at a forward edge. The flat stop engages the upper surface of the adjacent slat when in the extended position to restrict water passage therebetween. The awning rail also has a flat stop at an outer edge which engages the upper surface of the slat connected thereto when in the extended position to restrict water passage between the awning rail and the articulated cover. The awning rail preferably includes a retainer, a vertical leg securable to the wall, and a horizontal leg connecting and spacing apart the retainer and the vertical leg. The retainer and the vertical leg each extend above the horizontal leg to form a laterally extending gutter to direct water away from the cover. The vertical leg extends below the horizontal leg and is provided with fastener openings therebelow the gutter and substantially hidden from view.

13 Claims, 5 Drawing Sheets

FIG. 3
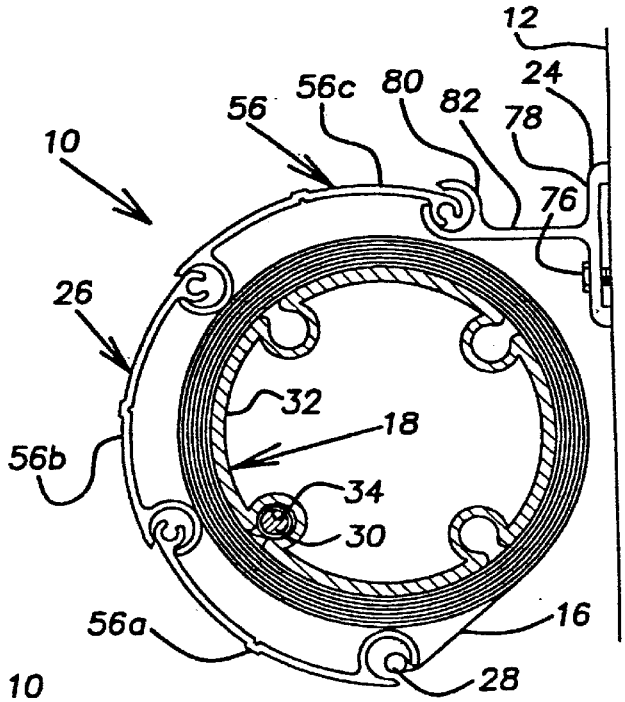
FIG. 4
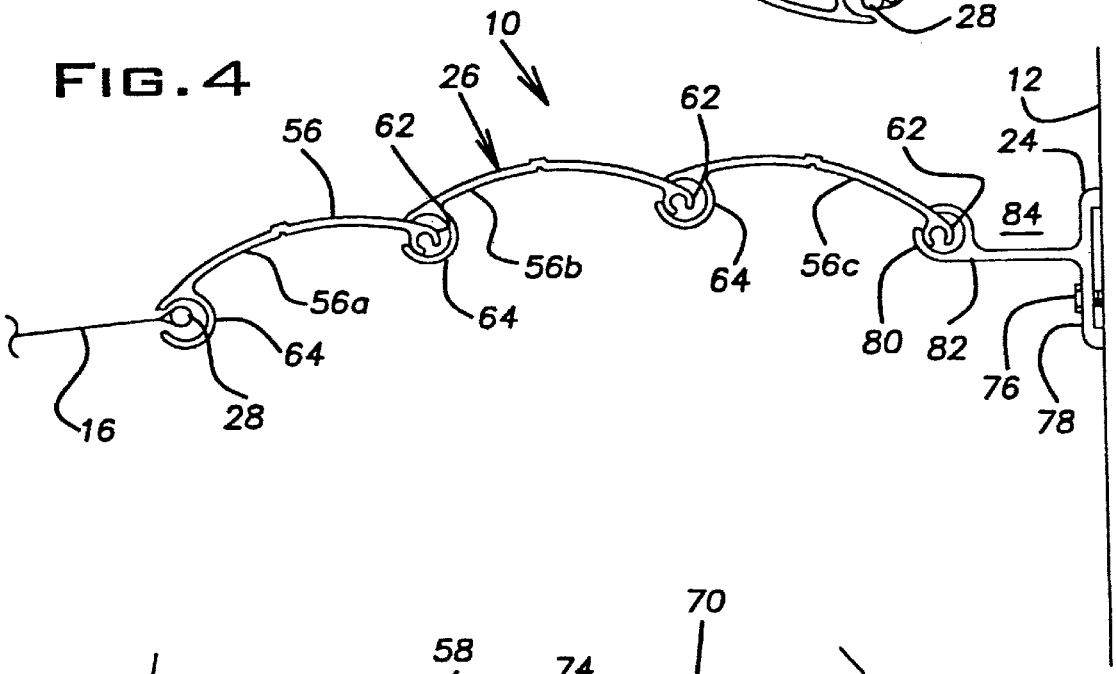
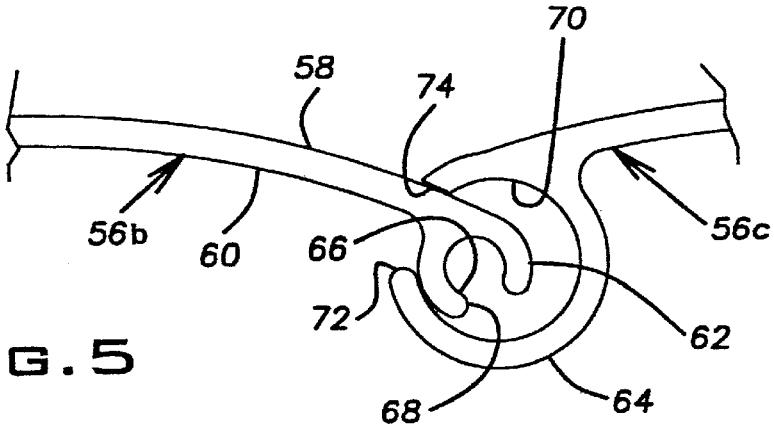
FIG. 5

FIG. 8
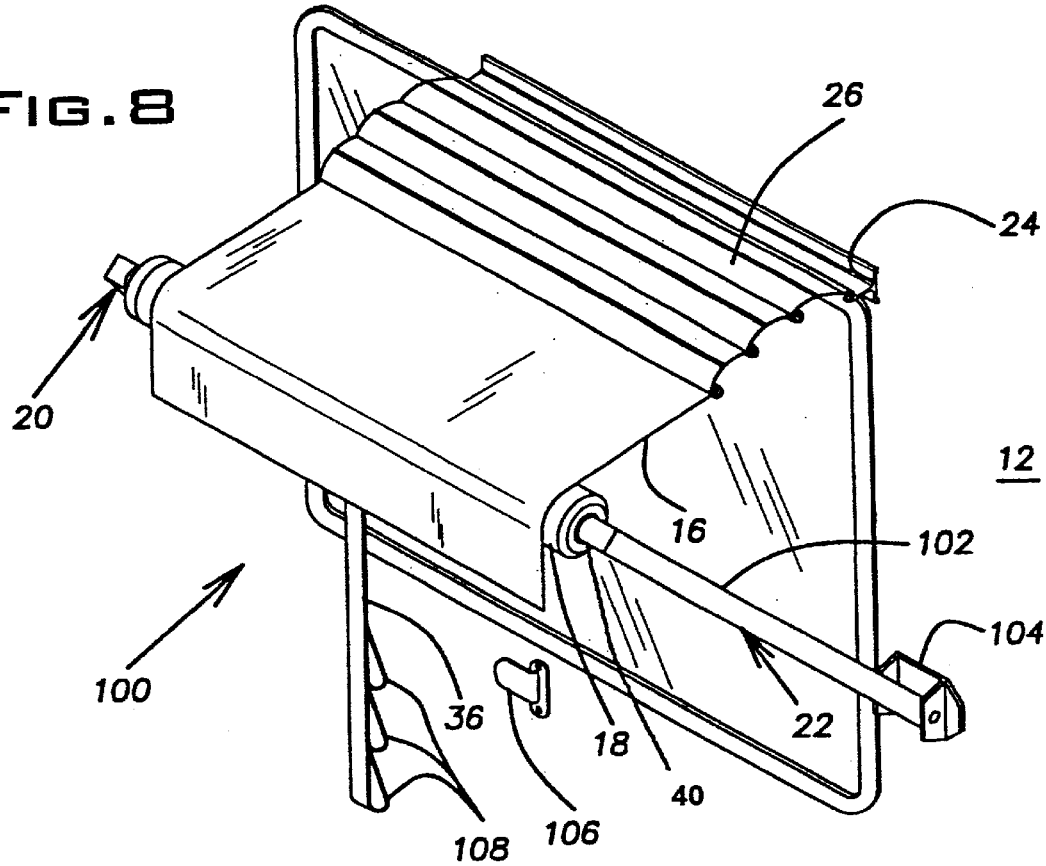
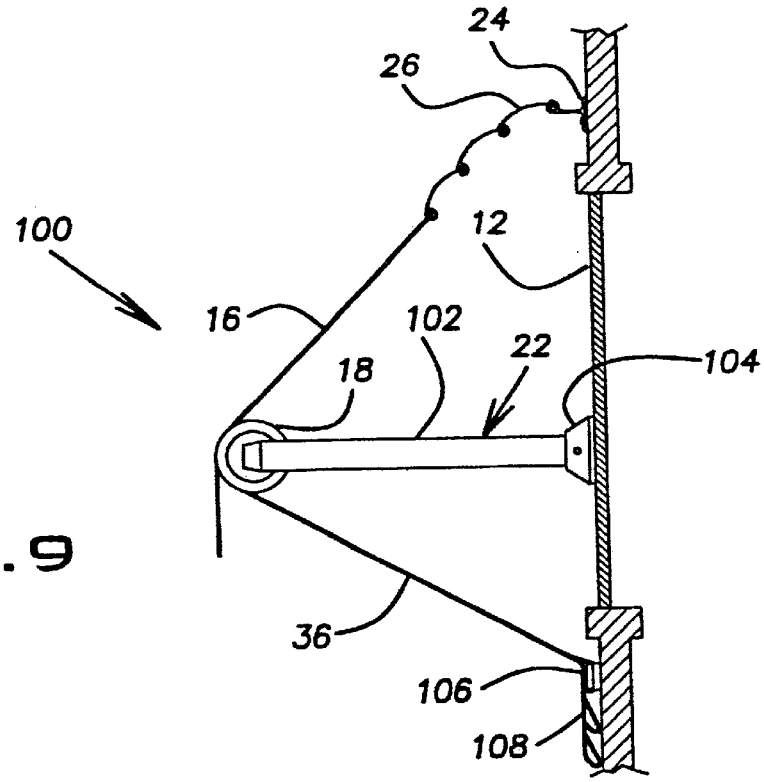
FIG. 9

FIG. 10
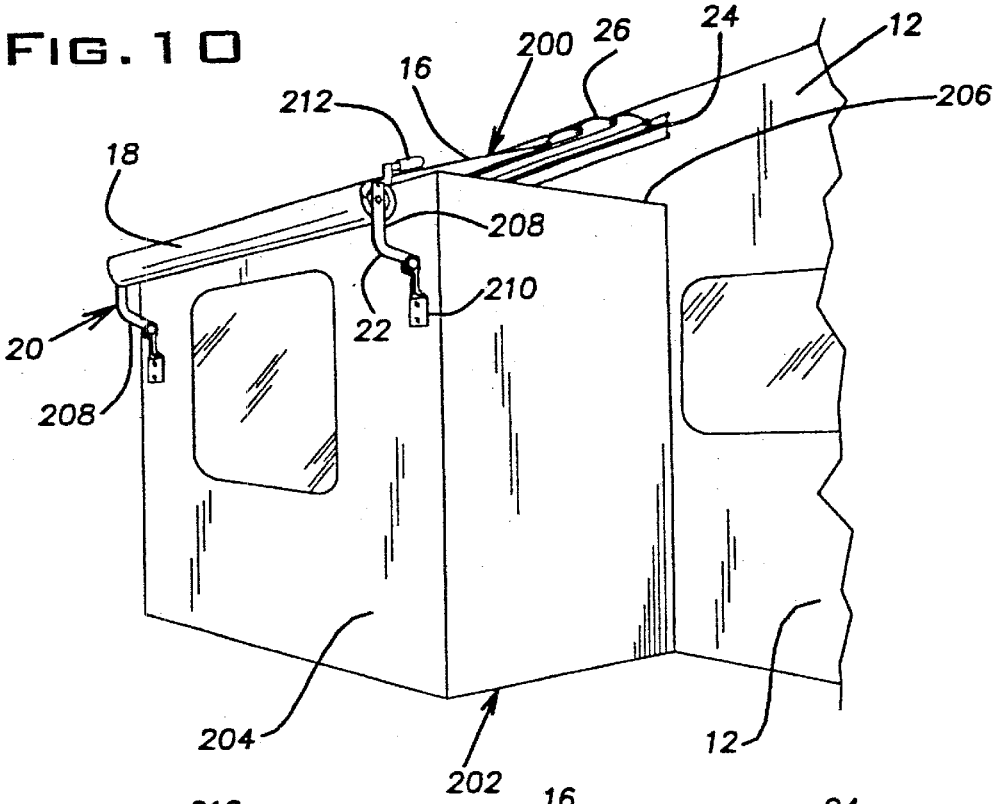
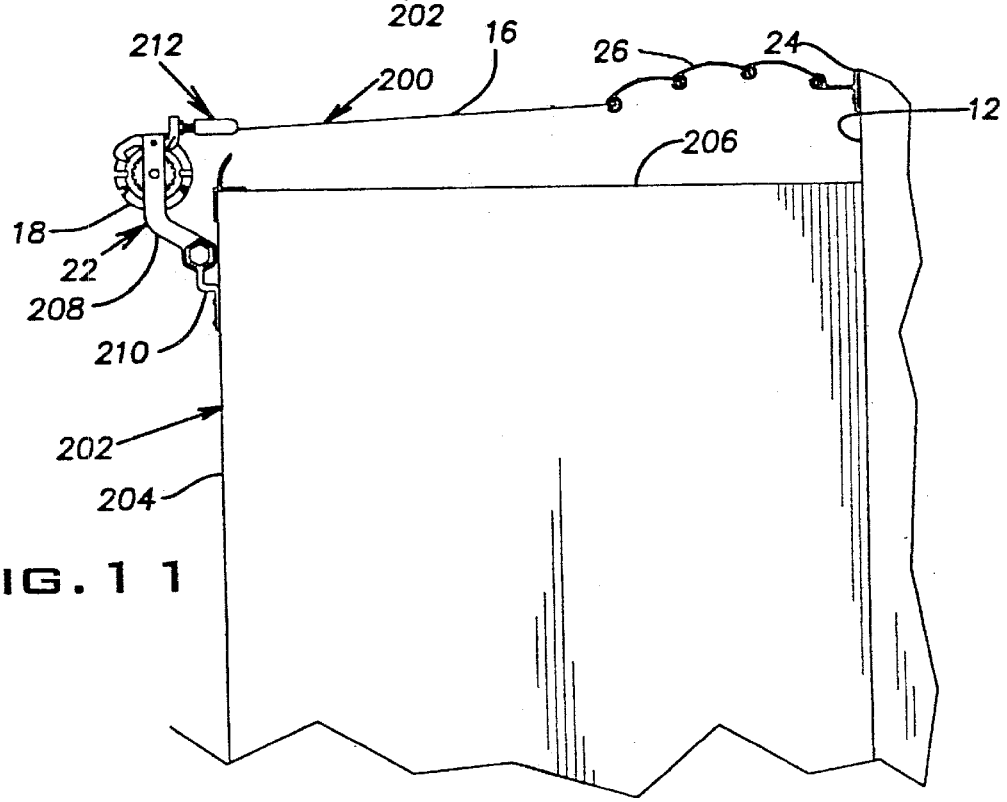
FIG. 11

COVER DESIGN FOR RETRACTABLE AWNINGS

BACKGROUND OF THE INVENTION

The present invention generally relates to retractable awnings and, more specifically, to retractable awnings having articulated covers.

There are numerous prior art retractable awning assemblies that support an awning or canopy to create a sheltered area. An inner end of the canopy is typically secured to a wall and an outer end of the canopy is typically secured to a roller assembly. The roller assembly is supported at its ends by support arms for movement between a retracted position, wherein the roller assembly is disposed adjacent the wall, and an extended position, wherein the roller assembly is spaced from the wall. When the roller assembly is in the retracted position, the canopy is rolled-up on the roller assembly. When the roller assembly is in the extended position, the canopy is unrolled from the roller assembly and extends between the wall and the roller assembly.

To protect the canopy in the retracted position, a cover is often provided. One type of cover includes five or six slats which are pivotally connected along their length in an articulated manner. The inner edge of the canopy is attached to the outermost one of the articulated slats, and the innermost slat is connected to an awning rail secured to the wall. The cover protects the canopy from environmental degradation by substantially enclosing the canopy when it is in the rolled-up retracted position.

While these prior awning assemblies may adequately perform their intended functions, they can have water leakage problems, can be relatively difficult to operate, and can have a large number of parts so that they are relatively difficult and expensive to manufacture. One problem with this type of awning cover is leakage of water through the joints between the slats and the joint between the innermost slat and the awning rail. Water, from rain or condensation from roof top air conditioners, comes in contact with the cover and leaks through the joints. Another problem with this type of retractable awning may be that the slats tend to bind up when the awning is retracted or extended. This may particularly be a problem if the rubber seals have been provided to address the water leakage problem. Another problem with this type of retractable awning is the large number of parts that the cover includes. Accordingly, there is a need in the art for an improved retractable awning with an articulated cover which has reduced water leakage through the cover, has a reduced tendency to bind, and/or is easier and less costly to manufacture.

BRIEF SUMMARY OF THE INVENTION

The present invention provides a retractable awning which overcomes at least some of the above noted problems of the related art. According to the present invention, the retractable awning assembly includes a roller, arm assemblies supporting ends of the roller, an awning rail securable to the wall, a flexible canopy rollable on the roller and having an outer edge secured to the roller and an inner edge connected to the awning rail, and an articulated cover connecting the flexible canopy to the awning rail. The articulated cover includes a plurality of slats hingedly connected one to another along adjacent edges such that the articulated cover at least partially encircles the flexible canopy and the roller in the retracted position and the cover is an extension of the flexible canopy in the extended position. Each of the slats has an upper surface and a flat stop at a forward edge. The flat stop engages the upper surface of the adjacent slat when in the extended position to restrict water passage therebetween.

According to another aspect of the present invention, the awning rail has a retainer for hingedly connecting one of the slats thereto and a flat stop at an outer edge. The flat stop of the awning rail engages the upper surface of the slat connected thereto when in the extended position to restrict water passage between the awning rail and the articulated cover.

According to yet another aspect of the present invention, the articulated cover includes only three slats. The slats are each rigid and arcuate so that they encircle more than half the diameter of the rolled canopy. The use of three rigid, arcuate slates provides the necessary articulation without binding yet provides the necessary rigidity to protect the canopy and to maintain an aesthetically pleasing circular shape when used with rollers having differing diameters.

According to yet another aspect of the present invention, the awning rail has a retainer, a substantially vertical leg securable to the wall, and a substantially horizontal leg connecting and spacing apart the retainer and the vertical leg. The retainer and the substantially vertical leg each extend above the substantially horizontal leg to form a laterally extending gutter. The gutter directs water away from the articulated cover and the canopy so that less water flows to the joints of the canopy.

BRIEF DESCRIPTION OF THE SEVERAL VIEWS OF THE DRAWING

These and further features of the present invention will be apparent with reference to the following description and drawings, wherein:

FIG. 3 is an enlarged and fragmented elevational view, partially in cross-section, of the door/window awning assembly of FIGS. 1 and 2 showing an end of the protective cover in the retracted position;

FIG. 4 is an enlarged and fragmented elevational view, partially in cross-section, of the door/window awning assembly of FIGS. 1 and 2 showing an end of the protective cover in the extended position;

FIG. 5 is an enlarged elevational view of a fragment of FIG. 4 showing a joint between slats of the protective over;

FIG. 8 is a perspective view of a window awning assembly in an extended position and having a protective cover according to the present invention;

FIG. 9 is an end elevational view of the window awning assembly of FIG. 8;

FIG. 10 is a perspective view of a slide-out cover assembly in an extended position and having a protective cover according to the present invention; and FIG. 11 is an end elevational view of the slide-out cover assembly of FIG. 10.

DETAILED DESCRIPTION OF PREFERRED EMBODIMENTS

Figure 1:
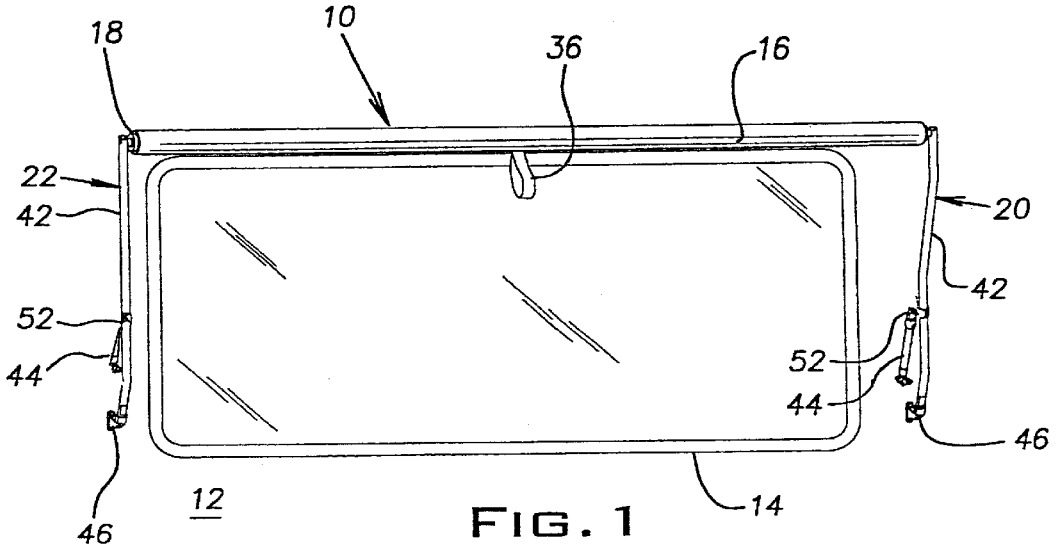
FIG. 1 is a perspective view of a door/window awning assembly in a retracted position and having a protective cover according to the present invention.
Figure 2:
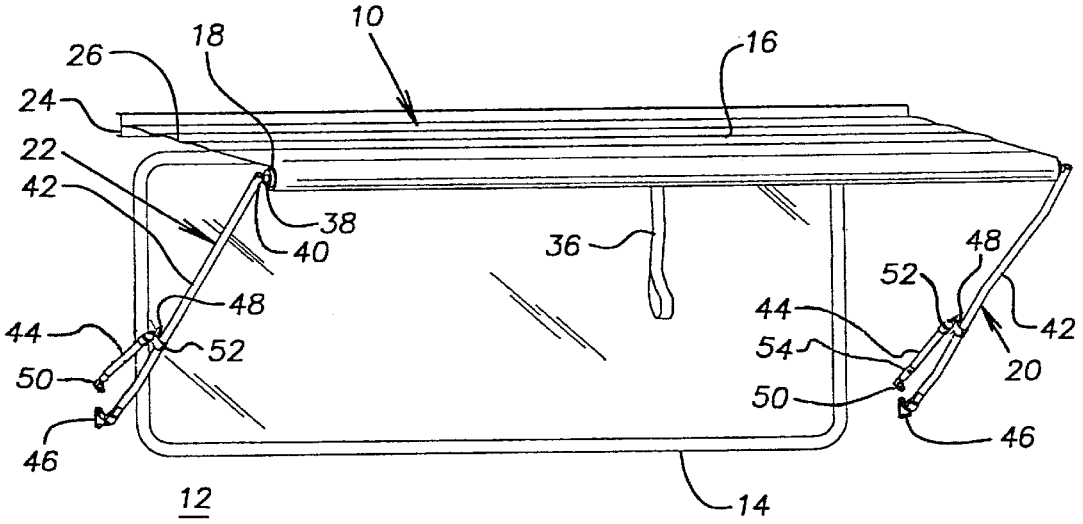
FIG. 2 is a perspective view of the door/window awning assembly of FIG. 1 in an extended position.

FIGS. 1 and 2 illustrate a retractable awning assembly 10 according to the present invention which is attached to a vertically-extending wall 12 such as the side of a recreational building or the side of a building. The term "recreational vehicle", as used in the specification and claims, includes campers, travel trailers, mobile homes, vans, buses, and the like. While the awning assembly 10 is particularly advantageous when attached to recreational vehicles, it can alternatively be attached to other vertically-extending walls such as, for example, the side of a building. The illustrated awning assembly 10 is shown located at a window 14 but it can be alternatively located at other locations such as, for example, a door, a patio, or any other location where a protective covering is desired.

The awning assembly 10 is operable between a retracted or stored position (shown in FIG. 1) and an extended or sheltering position (shown in FIG. 2). In the retracted position, the awning assembly 10 is in a compact configuration close to the side wall 12 of the recreational vehicle so that the recreational vehicle can travel to desired destinations. After a destination is reached, the awning assembly 10 can be deployed from the retracted position to the extended position if a covered area adjacent the window 14 is desired to protect against sun, rain, and the like.

The awning assembly 10 includes an awning or canopy 16 for selectively covering an area adjacent to the wall 12, a roller assembly 18 for furling and unfurling the canopy 16, right and left arm assemblies 20, 22 for supporting opposite ends of the roller assembly 18, an awning bracket or rail 24 for securing the inner end of the canopy 16 to the side wall 12, and a protective cover 26 extending between the canopy 16 and the awning rail 24 for protecting the canopy 16 when the awning assembly 10 is in the retracted position.

The canopy 16 is a sheet of flexible material such as, for example, fabric, canvas, acrylic, or nylon and is preferably rectangularly shaped. The inner or top edge of the canopy 16 is secured to the wall 12 by the awning rail 24 and the outer or bottom edge of the canopy 16 is secured to the roller assembly 18. As best shown in FIGS. 3 and 4, the inner and outer edges of the canopy 16 are each preferably provided with an awning rope 28, 30 or other suitable tubular member. Each awning rope 28, 30 is preferably a polypropylene rope and is preferably sewn in a hem or pocket formed at the edges of the canopy 16. The inner awning rope 28 is held by the protective cover 26 to secure the canopy to the side wall 12 as described in more detail hereinafter. The outer awning rope 30 is held by the roller assembly 18 as described in more detail hereinafter.

As best shown in FIG. 3, the roller assembly 18 preferably includes a roller tube 32. The roller tube 32 preferably has longitudinally extending channels or grooves 34 formed therein so that the outer awning rope 30 can be secured in one of the grooves 34 in a known manner. Additionally, an awning pull strap 36 (FIGS. 1 and 2) is preferably secured to one of the grooves 34 in a known manner. The pull strap 36 wraps around the roller tube 32 within the canopy 16 when the canopy 16 is rolled-up on the roller tube 32 so that a looped end slightly extends out of the canopy 16 when the canopy 16 is fully rolled-up onto the roller tube 32.

As best shown in FIGS. 1 and 2, a pair of end caps 38 close open ends of the roller tube 32. Each end cap 38 is rigidly secured to the roller tube 32 for rotation therewith and has a central opening therein. Axles or bars 40, which rotatably support the roller tube 32, extend through the central opening such that the roller tube 32 and the end caps 28 are free to rotate together with respect to the bars 40. The bars 40 form a rotational axis 36 for the roller tube 32 and support the roller tube 32. Preferably, a torsion spring (not shown) is operably connected between the roller tube 32 and the bar 40 in a known manner so that rotation of the roller tube 32 with respect to the bars 40 varies tension of the torsion spring. The torsion spring, therefore, can be preloaded for biasing the roller tube 32 to roll-up the canopy 16 onto the roller tube 32. Biased in this manner, the torsion spring both tensions the canopy 16 when the awning assembly 10 is held in the extended position and assists moving the awning assembling 10 from the extended position to the retracted position.

The bars 40 of the roller assembly 18 are supported by the arm assemblies 20, 22. Each arm assembly 20, 22 is disposed in a generally vertical plane at an associated side edge of the canopy 16 and an associated end of the roller assembly 18. Each arm assembly 20, 22 preferably includes an upright arm or support arm 42 and a telescoping tension rafter or rafter arm 44.

The support arms 42 each have an upper end connected to one of the bars 40 of the roller assembly 18 and a lower end pivotally connected to the wall 12 by a pivotable bottom hinge or joint 46. Mounted in this manner the support arms 42 pivot about the bottom hinges 46 to move the roller assembly 18 between the retracted position and the extended position. The support arms 42 carry a travel or support arm latch 48 for locking the support arms 42 in the retracted position adjacent the wall 12 and therefore locking the awning assembly 10 in the retracted position.

The rafter arms 44 each have an inner or lower end pivotally connected to the wall 12 by a pivotable bottom hinge or joint 50 and an outer or upper end pivotally connected to the support arm 42 with a pivotable top hinge or joint 52. Each rafter arm 40 preferably includes telescoping inner and outer members so that the length of the rafter arm 44 is variable and a lock 54 for locking the inner and outer members in an extended position to prevent them from telescopingly closing or retracting. When the awning assembly 10 is in the extended position, therefore, the extended and locked rafter arms 44 oppose the spring bias of the roller assembly 18 to hold the awning assembly 10 in the extended position.

For a more detailed description of a suitable roller assembly 18 and suitable arm assemblies 20, 22 see co-pending patent application Ser. No. 09/061,516, the disclosure of which is expressly incorporated herein it its entirety by reference. It is noted, however, that other configurations of roller assemblies and/or arm assemblies can be utilized within the scope of the present invention.

As best shown in FIGS. 3 and 4, the protective cover 26 includes a plurality of articulated strips or slats 56 which are hinged one to another so as to be pivotable relative to one another. When the awning assembly 10 is in the retracted position (FIG. 3), the slats 56 at least partially encircle the canopy 16 so as to protect the canopy 16 when it is wound on the roller assembly 18. When the awning assembly 10 is in the extended position (FIG. 4), the slats 56 form a generally co-planar extension of the canopy 16 between the canopy 16 and the awning rail 24.

For the illustrated window awnings, door awnings, and slide out covers, the protective cover 26 has three slats 56, an outer slat 56*a*, an intermediate slat 56*b*, and an inner slat 56*c*, which together encircle at least half of the roller assembly 18. It is noted however that the protective cover 26 can have additional slats 56 within the scope of the present invention. For larger awnings such as patio awnings, the protective cover preferably has 5 of the slats 56. The three slats 56 provide necessary articulation and protection while minimizing the total number of parts required. Having three slats 56 also provides a visually appealing appearance for roller assemblies of various diameters. The slats 56 are generally elongate and are sized to extend substantially the width of the canopy 16 so that the full width of the canopy 16 is protected. The slats 56 are preferably identical to reduce manufacturing costs and are preferably an extrusion of an aluminum alloy or other suitable rigid material.

Figure 7:
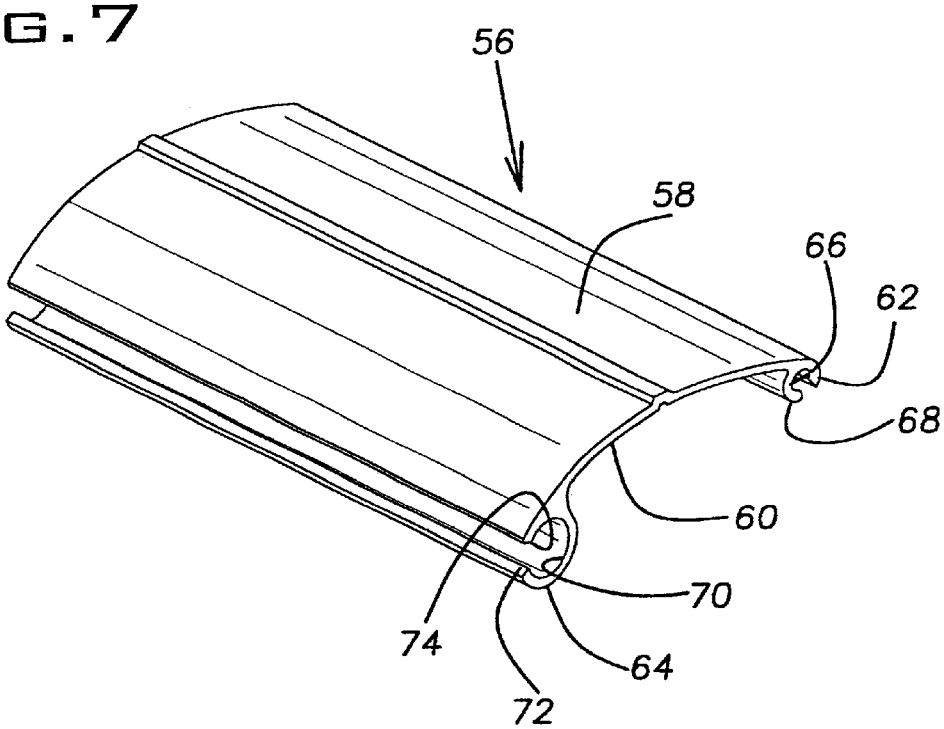
FIG. 7 is a perspective view of a cover slat of the awning assembly of FIGS. 1–4.

As best shown in FIG. 7, each slat 56 is generally arcuate having a generally convex upper surface 58 and a generally concave lower surface 60. Each slat 56 also has male connection element or detainer 62 transversely extending along an inner edge and a mating female connecting element or retainer 64 transversely extending along the opposite or outer edge. The detainer and retainer 62, 64 are sized and shaped so that the detainer 62 of one slat 56 is retained within the retainer 64 of an adjacent slat 56 to form an articulated tongue-in-groove-type joint between the connected slats 56.

The detainer generally projects perpendicularly away from the concave lower side 60 of the slat 56 and is generally C-shaped in cross-section to form a groove 66. The groove 66 is circular in cross-section and has a relatively narrow opening or slot 68 cooperating therewith along the length of the detainer 62. The slot 68 generally faces rearwardly and downwardly away from the concave lower side 60 of the slat 56.

The retainer 64 also projects perpendicularly away from the concave lower side 60 of the slat 56 and is generally C-shaped in cross-section to form a groove 70. The groove 70 is circular in cross-section and cooperates with a relatively narrow opening or slot 72 extending along the length of the retainer 64. The slot 72, however, faces generally forwardly and upwardly, that is, in a generally opposite direction from the slot 68 in the detainer 62.

As best shown in FIGS. 3–5, the detainer 62 has a larger outer diameter than the width of the slot 72 in the retainer 64 so that the detainer 62 is pivotally received and retained in the groove 70 of the retainer of an adjacent slat 56 with the slat 56 extending through the slot 72 of the retainer. Connected in this manner, the detainer 62 of the outer slat **56*a* is within the retainer 64 of the intermediate slat 56*b* and the detainer 62 of the intermediate slat 56*b* is within the retainer 64 of the inner slat 56*c*. Suitable screws (not shown) are preferably inserted in the ends of the detainer grooves 66 to longitudinally retain the detainers 62 in the ends of the retainer grooves 70**.

As best shown in FIG. 5, the outer edge of each slat 56 is provided with a flat surface or stop 74 at the upper side of the groove 70. The surface 74 is angled, that is, the surface 74 forms an acute angle with the upper surface 58 of that slat 56 so that it is tangent to the upper surface 58 of the adjacent slat 56 when the protective cover 26 is extended. When adjacent slats 56 are fully articulated, the surface 74 bears against the convex upper surface 58 of the adjacent slat 58 to form a depth of contact, that is, an area of contact having a suitable width to resist leakage is formed between generally parallel surfaces. The depth of the contact is generally equal to the wall thickness of the slat 56 and extends for the length of protective cover 26. This depth of contact provides a resistance to leakage and more preferably provides a generally water-tight seal against leakage. Contact pressure between the slats 56 is instrumental in limiting water seepage through the slat interconnections or joints. This contact pressure is preferably generated by tension of the canopy 16. The protective cover 26 has a nominal arch when extended which is flattened out somewhat when tension from the canopy 16 is applied. This further forces the slats 56 to their respective contact pressure locations and ensures that the slats 56 position themselves with the contact surfaces 74 parallel to each other.

As best shown in FIG. 4, the retainer 64 of the outer slat **56*a* has the inner edge the canopy 16 connected thereto. The retainer groove 70 has the inner awning rope 28 therein to secure the inner edge of the canopy 16 to the outer edge of the protective cover 26. Similarly, the detainer 62 of the inner slat 56*c* is pivotally connected to the awning rail 24**.

As best shown in FIGS. 3 and 4, the awning rail 24 horizontally extends along the wall 12. The awning rail 24 is rigidly secured to the wall 12 by suitable fasteners 76 such as, for example, the illustrated screws. The awning rail 24 is generally elongated and has a length substantially equal the width of the canopy 16 and the protective cover 26. The awning rail 24 is preferably an extrusion of an aluminum alloy or other suitable rigid material.

Figure 6:
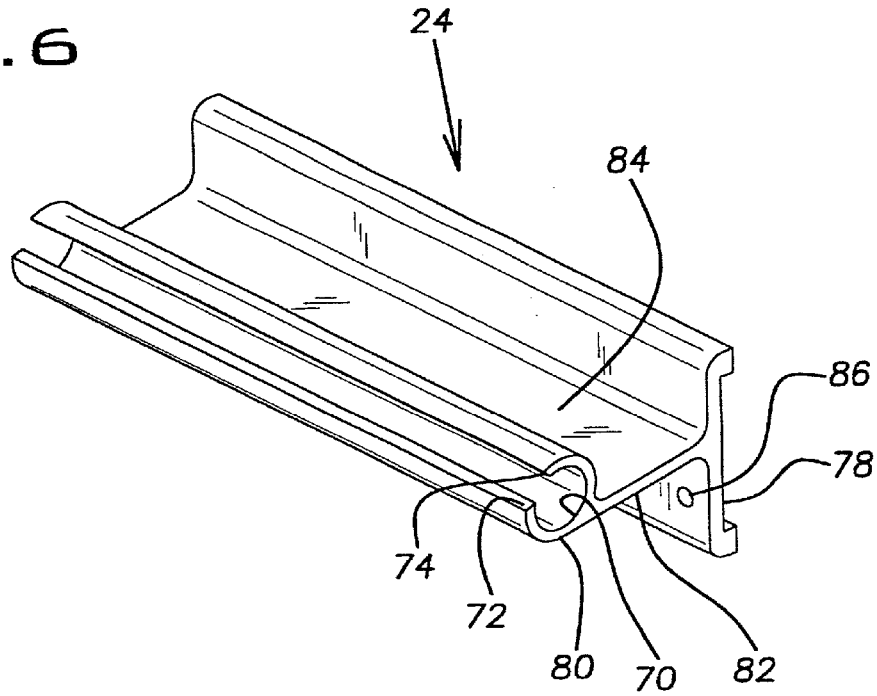
FIG. 6 is a perspective view of an awning rail of the awning assembly of FIGS. 1–4.

As best shown in FIG. 6, the awning rail 24 has a vertical leg 78, a retainer or female connecting element 80, and an intermediate or horizontal leg 82 spacing apart and connecting the vertical leg 78 and the retainer 80. The retainer 80 of the awning rail 24 is substantially the same as the retainers 64 of the cover slats 56 described hereinbefore. Therefore, the retainer 80 has a groove upper edge with an angled flat surface 74 which contacts the upper convex surface 58 of the inner slat **56*c* to form a depth of contact and provide a resistance to leakage between the awning rail 24 and the protective cover 26**.

The horizontal leg 82 outwardly spaces the retainer 80 apart from the vertical leg 78 and engages a lower portion of the retainer 80 so that the retainer 80 vertically extends above the horizontal leg 82. Preferably, the vertical leg 78 also extends above the horizontal leg 82 so that an upward facing channel or gutter 84 is formed above the horizontal leg 82 and between the retainer 80 and the vertical leg 78. Alternatively, the horizontal leg 82 can intersect the top of the vertical leg 78. In this alternative variation, the gutter 84 is formed above the horizontal leg 82 and between the retainer 80 and the side wall 12 when the awning rail 24 is mounted thereto or the gutter 84 is not formed when the awning rail 24 is mounted at the top of the side wall 12, but the retainer 80 limits water from running down onto the protective cover 26 and the canopy 16 such that water flows onto the roof. In yet another alternative variation, the horizontal leg could have a trough integrally formed therein to form the gutter.

The vertical leg 78 is preferably provided with suitable openings 86 for the mounting fasteners. The openings 86 are preferably located below the horizontal leg 82 so that they are not located on a surface forming the gutter 84. Located in this position, the fasteners 76 are shielded from water and sight so that no cover strips are required.

It should be noted that, while it is preferred to use the illustrated awning rail 24 in combination with the illustrated protective cover 26, improved results can also be obtained by using the illustrated awning rail 24 with prior art covers or using the illustrated protective cover 26 with prior art awning rails.

As best shown in FIG. 1, the support arms 42 and the rafter arms 44 each have a substantially parallel relationship with the wall 12 of the recreational vehicle and the canopy 16 is fully rolled-up on the roller assembly 18 when the awning assembly 10 is the retracted position. The protective cover 26 is tightly wound around the canopy 16 on roller assembly 18.

To open the awning assembly 10, the operator grasps the awning pull strap 36 and pulls to slightly unroll, such as about 1 inch, the canopy 16. The travel locks 48 are then manually unlocked while continuing to pull on the awning pull strap 36.

As best shown in FIGS. 2–4, the support arms 42 downwardly pivot outward about the bottom joint 46 as the roller assembly 18 is pulled outward by the awning pull strap 36. As the roller assembly 18 moves outwardly, the roller tube 32 rotates about the bars 40. The protective cover 26 automatically begins to unroll, or pivot open, as the roller tube 32 rotates. The detainer 62 of each slat 56 rotates within its cooperating retainer 64 and each slat 56 stops when the convex upper surface 58 engages the flat surface 74 of the inwardly adjacent slat 56. The canopy 16 is then unrolled from the roller tube 32 as the roller tube 32 continues to rotate.

As the support arms 42 downwardly pivot, the rafter arms 44 downwardly pivot outward about the bottom joint 50 and also pivot about the top joint 52 at the support arm 42. The length of the rafter arms 44 is increased as the inner and outer members slide relative to one another. The rafter arm locks 54 automatically lock when the rafter arms 44 are fully extended to predetermined lengths.

When the awning assembly is in the extended position, the pull strap 36 is released and the rafter arm locks 54 prevent the rafter arms 44 from telescoping closed and therefore prevents the awning assembly 10 from unintentionally retracting. Preferably, the pull strap 36 is then secured so that it does not become unattached and blow away. The torsion spring of the roller assembly 18 maintains tension on the canopy 16 and the protective cover 26 so that some contact pressure is maintained between the flat surfaces 74 and the convex upper surfaces 58.

When it rains, the gutter 84 laterally directs water to the sides of the awning assembly 10 to divert water away from the protective cover 26 and thereby reduces the amount of water which flows over the sloping protective cover 26 and canopy 16. Water flowing downward over the protective cover 26 tends to flow over the joints between the slats 56 because of the angle of the canopy 16 and the contact pressure of the flat surfaces 74 improves resistance to water penetration through the joints of the protective cover 26.

To close the awning assembly 10, the operator grasps the awning pull strap 36 and slightly pulls to remove tension from the rafter arm locks 54. The rafter arm locks 54 are then manually unlocked and the canopy 16 is allowed to roll-up onto the roller tube 32 by the bias of the torsion spring of the roller assembly 18.

As the canopy 16 is rolled onto the roller assembly 18, the support arms 42 upwardly pivot inward about the bottom joints 46. As the support arms 42 pivot, the rafter arms 44 upwardly pivot inward about the bottom joints 50 and also pivot about the top joints 52 carried by the support arms 42. The length of the rafter arms 44 is decreased as the inner and outer members slide relative to one another.

The travel locks 48 preferably automatically lock as the awning assembly 10 reaches the retracted position. The travel locks 48 prevent the support arms 38 from downwardly pivoting outward, and therefore prevent the awning assembly 10 from unintentionally deploying. When the awning assembly 10 is in the retracted position, the canopy 16 is fully rolled-up on the roller assembly 18 and the protective cover 26 is tightly wound over the canopy 16 to form a generally tubular shaped enclosure. The protective cover 26 closes the canopy 16 to protect the canopy 16 from the elements. Locked and closed in this manner, the awning assembly 10 is ready for travel.

FIGS. 8 and 9, illustrate a retractable awning assembly 100 for a window according to a second embodiment of the present invention wherein like reference numbers are used to indicate like structure. The awning assembly 100 illustrates that the protective cover 26 and the awning rail 24 can be utilized with different types of awning assemblies.

The awning assembly 100 includes the awning or canopy 16 for selectively covering an area adjacent to the wall 12 at a window, the roller assembly 18 for furling an unfurling the canopy 16, the right and left arm assemblies 20, 22 for supporting opposite ends of the roller assembly 18, the awning bracket or rail 24 for securing the inner end of the canopy 16 to the side wall 12, and the protective cover 26 extending between the canopy 16 and the awning rail 24 for protecting the canopy 16 when the awning assembly 100 is in the retracted position. The awning assembly 100 is substantially the same as the awning assembly 10 described herein above, the primary difference being that different arm assemblies 20, 22 are utilized.

Each arm assembly 20,22 includes a main arm or support arm 102 but no tension rafter or rafter arm is utilized. The support arms 102 each have an upper end connected to one of the bars 40 of the roller assembly 18 and a lower end pivotally connected to the wall 12 by a pivotable bottom hinge or joint 104. Mounted in this manner the support arms 102 pivot about the bottom hinges 104 to move the roller assembly 18 between the retracted position and the extended position. The support arms 102 preferably carry a travel or support arm latch (not shown) for locking the support arms 102 in the retracted position adjacent the wall 12 and therefore locking the awning assembly 100 in the retracted position.

The awning assembly 100 also includes a pull strap hanger 106 which is mounted to the wall 12 below the window. The end of the pull strap 36 is provided with a plurality of loops 108 which cooperate with the hanger 106 to secure the pull strap 36 thereto. When the awning assembly 100 is in the extended position, therefore, the pull strap 36 opposes the spring bias of the roller assembly 18 to hold the awning assembly 100 in the extended position.

As best shown in FIG. 9, the canopy 16 and the protective cover 26 are at a steep slope when the awning assembly 100 is in the extended position. Therefore, less contact pressure between the flat surfaces 74 and the convex outer surface of the slats 56 (FIG. 5) is necessary because the water has a tendency to flow downwardly over the joints between slats 56 rather than into the joints.

FIGS. 10 and 11 illustrate a retractable awning assembly 200 according to a third embodiment of the present invention wherein like reference numbers are used to indicate like structure. The awning assembly 200 further illustrates that the protective cover 26 and the awning rail 24 can be utilized with different types of awning assemblies.

In order to provide larger widths than can travel on roadways, some recreational vehicles are provided with a retractable structure usually referred to as a "slide-out" 202. Such slide-outs are generally rectangularly-shaped and movable between an extended position (shown in FIGS. 10 and 11) and a retracted position (not shown). When the slide-out 202 is in the extended position, the slide-out 202 perpendicularly extends from the side wall 12 of the recreational vehicle with an outer wall 204 of the slide-out generally parallel and spaced apart from the side wall 12 of the recreational vehicle. When the slide-out 202 is in the retracted position, the slide-out 202 is located within the interior of the recreational vehicle with the outer wall 204 of the slide-out generally co-planar with or adjacent the side wall 12 of the recreational vehicle. With the slide-out 202 in the retracted position, the recreational vehicle can travel on roadways.

The awning assembly 200 covers the slide-out 202 in order to prevent snow, leaves, water, or other debris from collecting on the substantially horizontal roof 206 of the slide-out 202 when it is in the extended position. The awning assembly 200 includes the awning or canopy 16 for automatically covering the roof of the slide-out, the roller assembly 18 for furling and unfurling the canopy 16, the right and left arm assemblies 20, 22 for supporting opposite ends of the roller assembly 18, the awning bracket or rail 24 for securing the inner end of the protective cover 26 to the side wall 12, and the protective cover 26 extending between the canopy 16 and the awning rail 24 for protecting the canopy 16 when the awning assembly 200 is in the retracted position. The awning assembly 200 is substantially the same as the awning assemblies 10, 100 described herein above, the primary difference being that different arm assemblies 20, 22 are utilized.

Each arm assembly 20, 22 includes a main arm or support arm 208 but no tension rafter or rafter arm is utilized. The support arms 208 each have an upper end connected to one end of the roller assembly 18 and a lower end rigidly connected to the outer wall 204 by a bracket 210. The bracket 210 is rigidly secured to the outer wall by suitable fasteners. The support arms 208 are sized and shaped to locate the roller assembly 18 near the outer wall 204 and at least partially above the roof 206. Mounted in this manner the support arms 208 maintain the position of the roller assembly 18 relative to the outer wall 204 so that it is automatically moved with the slide-out 202 between the retracted position and the extended position. The support arms 208 preferably carry a travel lock 212 for automatically locking the roller assembly 18 against rotation when in the retracted position.

As best shown in FIG. 11, the canopy 16 and the protective cover 26 are substantially horizontal when the awning assembly 200 is in the extended position. Therefore, greater contact pressure between the flat surfaces 74 and the convex outer surface of the slats 56 (FIG. 5) is necessary because water has a tendency to pool at the joints between slats 56 rather than flowing downwardly over the joints.

For a more detailed description of a suitable awning assembly for a slide-out see U.S. Pat. No. 7,752,536, the disclosure of which is expressly incorporated herein it its entirety by reference.

Although particular embodiments of the invention have been described in detail, it will be understood that the invention is not limited correspondingly in scope, but includes all changes and modifications coming within the spirit and terms of the claims appended hereto.

What is claimed is:

1. A retractable awning assembly for mounting to a wall and operable between a retracted position and an extended position, said awning assembly comprising:

a roller;

arm assemblies supporting ends of said roller;

an awning rail securable to the wall;

a flexible canopy rollable on said roller and having an outer edge secured to said roller and an inner edge; and an articulated cover connecting said inner edge of said flexible canopy to said awning rail, said cover including a plurality of slats hingedly connected one to another along adjacent edges such that said articulated cover at least partially encircles said flexible canopy and said roller in the retracted position and said cover is an extension of said flexible canopy in the extended position, each of said slats having an upper surface and a flat stop at a forward edge, said flat stop engaging in generally parallel communication with the upper surface of an adjacent slat in the extended position to restrict water passage between connected slats;

said upper surface being convex and the generally parallel flat stop being tangent thereto when in the extended position.

2. The retractable awning according to claim 1, wherein said flat stop of each slat generally forms an acute angle relative to said upper surface of the slat.

3. The retractable awning according to claim 1, wherein said flat stop of each slat forms an acute angle relative to said upper surface of the slat.

4. The retractable awning according to claim 1, wherein said flat stop has a width substantially equal to a wall thickness of said slat at the outer edge of said slat.

5. The retractable awning according to claim 1, wherein said articulated cover includes only three of said slats.

6. The retractable awning according to claim 1, wherein said awning rail has a retainer for hingedly connecting one of said slats thereto and a flat stop at an outer edge, said flat stop engaging in generally parallel communication with the upper surface of the slat connected thereto when in the extended position to restrict water passage between said awning rail and said cover.

7. The retractable awning according to claim 1, wherein said awning rail has a retainer for hingedly connecting one of said slats thereto, a substantially vertical leg securable to the wall, and a substantially horizontal leg connecting and spacing apart the retainer and the vertical leg.

8. The retractable awning according to claim 7, wherein said retainer and said substantially vertical leg each extend above said substantially horizontal leg to form a gutter between said retainer and said substantially vertical leg and above said substantially horizontal leg.

9. A retractable awning assembly for mounting to a wall and operable between a retracted position and an extended position, said awning assembly comprising:

a roller;

arm assemblies supporting ends of said roller;

an awning rail securable to the wall;

a flexible canopy rollable on said roller and having an outer edge secured to said roller and an inner edge connected to said awning rail; and an articulated cover connecting said inner edge of said flexible canopy to said awning rail, said articulated cover including only three arcuate slats hingedly connected to one another alone adjacent edges such that said cover at least partially encircles said flexible canopy and said roller in the retracted position and said cover is an extension of said flexible canopy in the extended position;

each of said slats having an upper surface and a flat stop at a forward edge, said flat stop engaging in generally parallel communication with the upper surface of an adjacent slat when in the extended position to restrict water passage between connected slats;

said upper surface being convex and said flat stop being tangent thereto in the extended position.

10. The retractable awning according to claim 9, wherein said flat stop has a width substantially equal to a wall thickness of said slat at the outer edge of said slat.

11. The retractable awning according to claim 9, wherein said awning rail has a retainer for hingedly connecting one of said slats thereto and a flat stop at an outer edge, said flat stop engaging the upper surface of the slat connected thereto in the extended position to restrict water passage between said awning rail and said articulated cover.

12. The retractable awning according to claim 9, wherein said awning rail has a retainer for hingedly connecting one of said slats thereto, a substantially vertical leg securable to the wall, and a substantially horizontal leg connecting and spacing apart the retainer and the vertical leg.

13. The retractable awning according to claim 12, wherein said retainer and said substantially vertical leg each extend above said substantially horizontal leg to form a gutter between said retainer and said substantially vertical leg and above said substantially horizontal leg.

* * * * *